United States Patent [19]

Fassett et al.

[11] 3,940,770

[45] Feb. 24, 1976

[54] CYLINDRICAL ARRAY ANTENNA WITH RADIAL LINE POWER DIVIDER

[75] Inventors: Matthew Fassett, Billerica, Mass.; Quirino Balzano, Pembroke Pines, Fla.

[73] Assignee: Raytheon Company, Lexington, Mass.

[22] Filed: Apr. 24, 1974

[21] Appl. No.: 463,499

[52] U.S. Cl. ..... 343/754; 343/854

[51] Int. Cl.[2] ..... H01Q 19/06; H01Q 3/26

[58] Field of Search ..... 343/777, 778, 854, 754

[56] References Cited

UNITED STATES PATENTS

| | | | |
|---|---|---|---|
| 3,568,207 | 3/1971 | Boyns et al. | 343/854 |
| 3,653,057 | 3/1972 | Charlton et al. | 343/854 |
| 3,680,140 | 7/1972 | Chalfin | 343/854 |
| 3,729,742 | 4/1973 | Boyns | 343/854 |
| 3,827,055 | 7/1974 | Bogner et al. | 343/854 |

*Primary Examiner*—Eli Lieberman

*Attorney, Agent, or Firm*—Richard M. Sharkansky; Philip J. McFarland; Joseph D. Pannone

[57] ABSTRACT

A cylindrical array antenna is disclosed wherein rows of antenna elements disposed about the periphery of the antenna each include a feed network coupled to a monopulse arithmetic unit through a radial line power divider and a hemispherical sector selector switching network. Monopulse "sum" and circumferential "difference" patterns are obtained by dividing a selected hemispherical sector into four adjacent antenna aperture segments. The antenna elements associated with alternate antenna aperture segments are coupled to the arithmetic unit in like polarity and the antenna elements associated with adjacent antenna aperture segments are coupled to such arithmetic unit in opposite polarity. With such arrangement cross-polarization or "null filling" effects associated with the cylindrical array antenna are reduced.

5 Claims, 13 Drawing Figures

| HEMISPHERICAL SECTOR | INPUT FEED PORTS COUPLED TO INPUT TERMINALS ($i_1$) OF SWITCHING ELEMENTS $402_9$-$402_{12}$ | STATE OF SWITCHING ELEMENTS | | | | | | | | | | | |
|---|---|---|---|---|---|---|---|---|---|---|---|---|---|
| | | $402_1$ | $402_2$ | $402_3$ | $402_4$ | $402_5$ | $402_6$ | $402_7$ | $402_8$ | $402_9$ | $402_{10}$ | $402_{11}$ | $402_{12}$ |
| 1 | $316_1$ - $316_4$<br>$318_1$ - $318_4$ | 1 | 1 | 1 | 1 | - | - | - | - | 1 | 1 | 1 | 1 |
| 2 | $316_2$ - $316_5$<br>$318_2$ - $318_5$ | - | 1 | 1 | 1 | 1 | - | - | - | 2 | 1 | 1 | 1 |
| 3 | $316_3$ - $316_6$<br>$318_3$ - $318_6$ | - | - | 1 | 1 | 1 | 1 | - | - | 2 | 2 | 1 | 1 |
| 4 | $316_4$ - $316_7$<br>$318_4$ - $318_7$ | - | - | - | 1 | 1 | 1 | 1 | - | 2 | 2 | 2 | 1 |
| 5 | $316_5$ - $316_8$<br>$318_5$ - $318_8$ | - | - | - | - | 1 | 1 | 1 | 1 | 2 | 2 | 2 | 2 |
| 6 | $316_6$ - $316_9$<br>$318_6$ - $318_9$ | 2 | - | - | - | - | 1 | 1 | 1 | 1 | 2 | 2 | 2 |
| 7 | $316_7$ - $316_{10}$<br>$318_7$ - $318_{10}$ | 2 | 2 | - | - | - | - | 1 | 1 | 1 | 1 | 2 | 2 |
| 8 | $316_8$ - $316_{11}$<br>$318_8$ - $318_{11}$ | 2 | 2 | 2 | - | - | - | - | 1 | 1 | 1 | 1 | 2 |
| 9 | $316_9$ - $316_{12}$<br>$318_9$ - $318_{12}$ | 2 | 2 | 2 | 2 | - | - | - | - | 1 | 1 | 1 | 1 |
| 10 | $316_{10}$ - $316_{13}$<br>$318_{10}$ - $318_{13}$ | - | 2 | 2 | 2 | 2 | - | - | - | 2 | 1 | 1 | 1 |
| 11 | $316_{11}$ - $316_{14}$<br>$318_{11}$ - $318_{14}$ | - | - | 2 | 2 | 2 | 2 | - | - | 2 | 2 | 1 | 1 |
| 12 | $316_{12}$ - $316_{15}$<br>$318_{12}$ - $318_{15}$ | - | - | - | 2 | 2 | 2 | 2 | - | 2 | 2 | 2 | 1 |
| 13 | $316_{13}$ - $316_{16}$<br>$318_{13}$ - $318_{16}$ | - | - | - | - | 2 | 2 | 2 | 2 | 2 | 2 | 2 | 2 |
| 14 | $316_{14}$ - $316_1$<br>$318_{14}$ - $318_1$ | 1 | - | - | - | - | 2 | 2 | 2 | 1 | 2 | 2 | 2 |
| 15 | $316_{15}$ - $316_2$<br>$318_{15}$ - $318_2$ | 1 | 1 | - | - | - | - | 2 | 2 | 1 | 1 | 2 | 2 |
| 16 | $316_{16}$ - $316_4$<br>$318_{16}$ - $318_4$ | 1 | 1 | 1 | - | - | - | - | 2 | 1 | 1 | 1 | 2 |

TABLE I

FIG. 6

| HEMISPHERICAL SECTOR | INPUT FEED PORT COUPLER TO | | | | STATE OF SWITCHING ELEMENTS | |
|---|---|---|---|---|---|---|
| | LINE $A_1$ | LINE $A_2$ | LINE $A_3$ | LINE $A_4$ | $402_{13}$ | $402_{14}$ |
| 1 | $316_1$ | $316_2$ | $316_3$ | $316_4$ | 1 | 1 |
| 2 | $316_5$ | $316_4$ | $316_3$ | $316_2$ | 1 | 2 |
| 3 | $316_3$ | $316_4$ | $316_5$ | $316_6$ | 2 | 2 |
| 4 | $316_7$ | $316_6$ | $316_5$ | $316_4$ | 2 | 1 |
| 5 | $316_5$ | $316_6$ | $316_7$ | $316_8$ | 1 | 1 |
| 6 | $316_9$ | $316_8$ | $316_7$ | $316_6$ | 1 | 2 |
| 7 | $316_7$ | $316_8$ | $316_9$ | $316_{10}$ | 2 | 2 |
| 8 | $316_{11}$ | $316_{10}$ | $316_9$ | $316_8$ | 2 | 1 |
| 9 | $316_9$ | $316_{10}$ | $316_{11}$ | $316_{12}$ | 1 | 1 |
| 10 | $316_{13}$ | $316_{12}$ | $316_{11}$ | $316_{10}$ | 1 | 2 |
| 11 | $316_{11}$ | $316_{12}$ | $316_{13}$ | $316_{14}$ | 2 | 2 |
| 12 | $316_{15}$ | $316_{14}$ | $316_{13}$ | $316_{12}$ | 2 | 1 |
| 13 | $316_{13}$ | $316_{14}$ | $316_{15}$ | $316_{16}$ | 1 | 1 |
| 14 | $316_1$ | $316_{16}$ | $316_{15}$ | $316_{14}$ | 1 | 2 |
| 15 | $316_{15}$ | $316_{16}$ | $316_1$ | $316_2$ | 2 | 2 |
| 16 | $316_3$ | $316_2$ | $316_1$ | $316_{16}$ | 2 | 1 |

TABLE II

FIG. 7

CYLINDRICAL ARRAY ANTENNA WITH RADIAL LINE POWER DIVIDER

BACKGROUND OF THE INVENTION

This invention relates generally to array antennas used in radar systems and feed networks for such antennas and more particularly to antennas of such type which are adapted to provide monopulse tracking.

As is known in the art, array antennas, such as cylindrical array antennas, have been suggested for use in many applications of radar requiring wide scan angle coverage, such as in known airborne "multimode" radar systems. In such a type of array antenna a plurality of antenna elements circumferentially disposed on the surface of a cylinder corresponding generally to a portion of the fuselage of an aircraft are coupled to a transmitter/receiver through a feed network. Various types of feed networks generally used in such applications are described in an article entitled "A Survey of Circular Symmetric Arrays" by J. H. Provencher published in the book "Phased Array Antennas" edited by Drs. A. A. Olinir and G. H. Knittel, published in 1972 by Artech House, Inc., 610 Washington Street, Dedham, Mass. 02026. The feed networks shown in the just-cited reference include various kinds of switching arrangements to direct radio frequency energy to selected sectors of the antenna array so that a resulting beam has a desired circumferential position. It is obviously desirable that the particular feed network and the switching arrangement used therewith include a minimum number of switching elements in order that power loss, phase error and amplitude error within the antenna be, in turn, reduced to a minimum. While the feed networks described in the above mentioned article have been found adequate in many applications, such networks require the use of a relatively large number of switching elements. The concomitant losses and errors inherent in such networks then militate against their use in applications in which beam shape and low sidelobe levels of a beam are of primary importance.

The shortcomings of known feed networks for the antenna elements of an array antenna are especially evident when a cylindrical or frusto-conical shaped array is desired to provide monopulse tracking of targets within a relatively wide field. It is generally desirable with any such array that the gain of the antenna be maximized for both circumferential and axial scans.

In order to maximize the gain of such an antenna array in the axial direction, it is desirable that the radiating elements be configured so that the E field (i.e. the polarization) of the radio frequency energy in the "near" field is codirectional with the longitudinal axis of the array. It follows, then, that when axial scanning is effected (i.e. when the beam is scanned in a plane containing the longitudinal axis of the array) the "far" electric field may be considered as having a component orthogonal to the radiating face of the array. This component in turn has two components, one orthogonal to a selected antenna "plane" (i.e. any plane orthogonal to the normal to the array at the center of the beam) and the other being parallel to such antenna "plane." Unfortunately, then, if any of the feed networks of any of the antenna arrays illustrated in the cited reference are adapted for use in either a cylindrical or a frusto-conical array, undesirable cross-polarization components exist between radiating elements. That is, with known feed networks the "far" electric field component parallel to the "plane" (i.e. the cross-polarization components) generally seriously degrades the antenna monopulse "sum" and "difference" patterns at large axial scan angles. Such pattern degradation is sometimes referred to as "null filling" because the cross-polarization components tend to form a "sum type" pattern for the monopulse "difference" patterns and also tend to form a "difference type" pattern for the monopulse "sum" pattern at the center of such patterns.

SUMMARY OF THE INVENTION

With this background of the invention in mind it is therefore an object of this invention to provide an improved nonplanar array antenna.

It is another object of this invention to provide a nonplanar array antenna having an improved feed network.

It is another object of this invention to provide a nonplanar array antenna having improved monopulse tracking in two orthogonal planes.

These and other objects of the invention are generally attained by providing at least two pairs of antenna aperture segments, each one of such segments including at least one axial row of antenna elements, such antenna elements being arranged to form an antenna array, and, means for coupling the antenna elements in alternate antenna aperture segments with like polarity and the antenna elements in adjacent antenna aperture segments with opposite polarity. The coupling means includes a centrally fed radio frequency lens having a plurality of output ports disposed about the periphery thereof and a smaller plurality of input feed ports disposed centrally within the lens, such input feed ports being selectively coupled to a monopulse arithmetic network by means of a switching network.

In a preferred embodiment in a cylindrical array antenna each one of the antenna elements includes a phase shifter to collimate and direct shaped beams of radiation in both azimuthal (or circumferential) and elevation (or axial) directions in a selected one of $n$ different overlapping hemispherical sectors. Two centrally fed radio frequency lenses (sometimes alternatively called radial line power dividers) are provided; one for the monopulse "sum" and circumferential "difference" patterns and one for the monopulse axial "difference" pattern. The antenna elements in each row are combined by a center fed serial feed network, thereby providing each row of elements with a "sum" and axial "difference " output. The "sum" outputs of the center fed serial feed networks are fed to the "sum" and circumferential "difference" radial line power divider while the "difference" outputs are fed to the axial "difference" radial line power divider. The radial line power dividers provide a desired amplitude distribution to the antenna elements and couple four of $n$ of the inner feed ports thereof in proper phase and amplitude excitation at any instant in time to a selected one of the $n$ hemispherical sectors. Four selected inner feed ports of the "sum" and circumferential "difference" radial line power dividers are coupled respectively to four adjacent antenna aperture segments. Adjacent ones of such four selected input feed ports are combined in opposite polarity to reduce the effect of cross polarization or null filling caused by axial scanning the antenna.

BRIEF DESCRIPTION OF THE DRAWINGS

For a more complete understanding of this invention, reference is now made to the following description of a preferred embodiment and to the drawings, in which:

FIG. 6 is TABLE I, useful in describing the relationship between the state of the switching elements used in the switching networks shown in FIG. 4 and the hemispherical sectors selected by a beam steering computer;

FIG. 7 is TABLE II, useful in understanding the operation of the null filling comparator shown in FIG. 4.

DESCRIPTION OF THE PREFERRED EMBODIMENTS GENERAL

Figure 8:
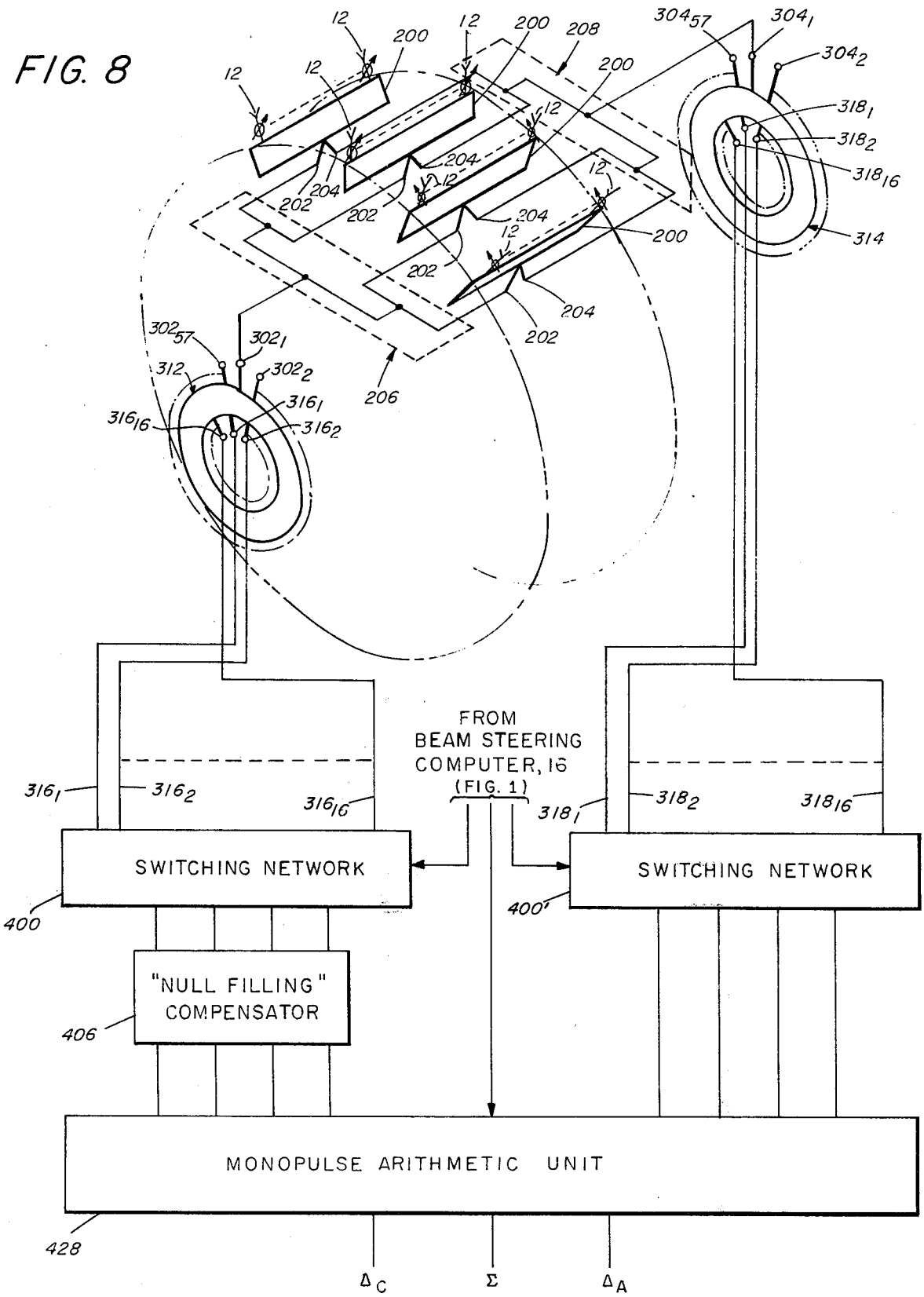
FIG. 8 is a diagram greatly simplified for clarity showing, in a single figure, the relationship between the elements of the diagrams shown in FIG. 2 and FIG. 4.

Referring now to FIG. 8, a cylindrical array antenna 10 includes a plurality of antenna elements 12 each including a phase shifter (not numbered) (responsive to control signals supplied by beam steering computer 16 via lines (not shown in this figure)) to collimate and direct shaped beams of radiation in both azimuthal (or circumferential) and elevation (or axial) directions in a selected one of *n*, here 16, different overlapping hemispherical sectors, such sector being selected in response to control signals supplied by beam steering computer 16 to switching networks 400, 400′. Radio frequency energy to and from the antenna elements 12 in each row are combined by a center fed serial feed network 200, thereby providing each row of elements 12 with a "sum" and "axial" difference output (i.e., "sum" port 202 and "difference" port 204, respectively). Two centrally fed radio frequency lenses 312, 314 (sometimes alternatively called radial line power dividers) are provided; one for the monopulse "sum" and circumferential "difference" patterns and the other one for the monopulse axial "difference" pattern.

The "sum" ports 202 are connected to the "sum" and circumferential "difference" radial line power divider 312 and the "difference" ports 204 are connected to the axial "difference" radial line power divider 314.

The inner feed ports $\mathbf{316_1}$–$\mathbf{316_{16}}$ and $\mathbf{318_1}$–$\mathbf{318_{16}}$ are connected to switching networks 400, 400′. In response to signals supplied by beam steering computer 16 (FIG. 1), four successively disposed input feed ports are coupled to the four output terminals of such switching networks 400, 400′.

The output ports of switching network 400 are coupled to a "null filling" compensator 406. The "null filling" compensator 406 couples adjacent ones of the four selected inner input ports $\mathbf{316_1}$–$\mathbf{316_{16}}$ to monopulse arithmetic unit 428. As described in connection with FIG. 4, such compensator is operative to reduce the effect of cross polarization or "null filling" on the monopulse circumferential "difference" pattern and on the monopulse "sum" pattern.

Four adjacent input feed ports $\mathbf{318_1}$–$\mathbf{318_{16}}$ are correspondingly coupled by switching network 400′ to the monopulse arithmetic unit 428 where they are combined in phase thereby to form the monopulse axial "difference" pattern (i.e., at port $\Delta_A$).

Figure 1:
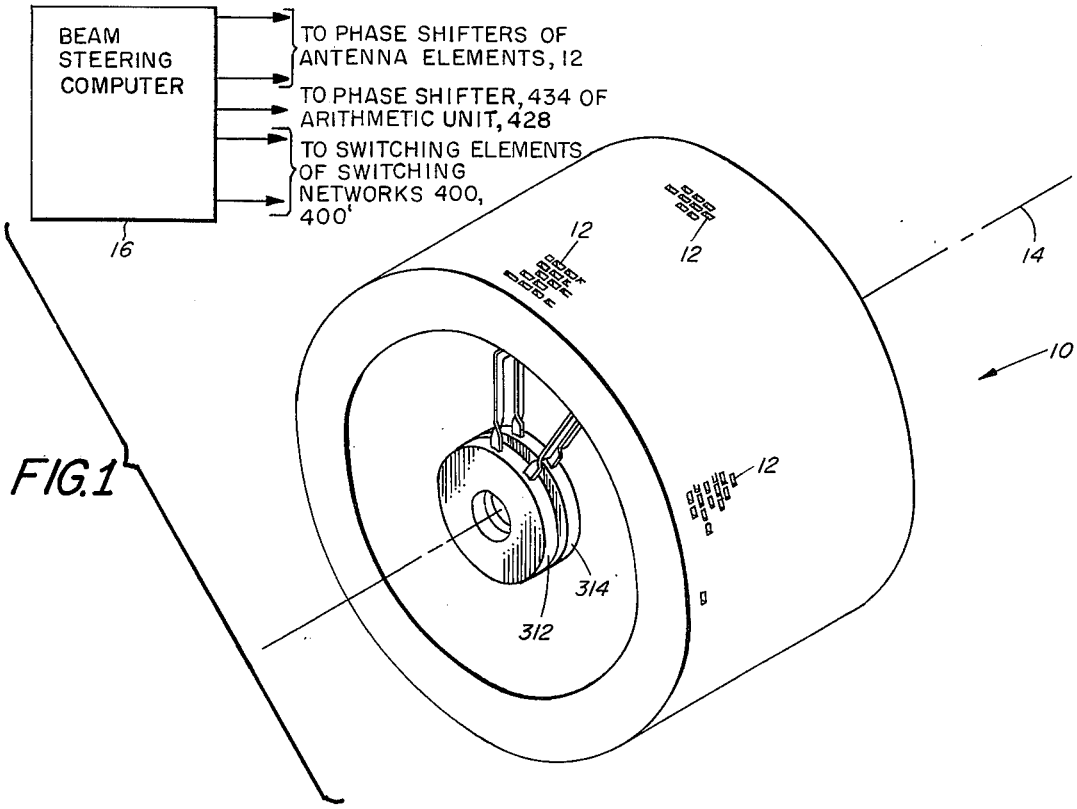
FIG. 1 is an isometric drawing, greatly amplified, of a portion of the cylindrical array antenna system according to the invention.
Figure 5:
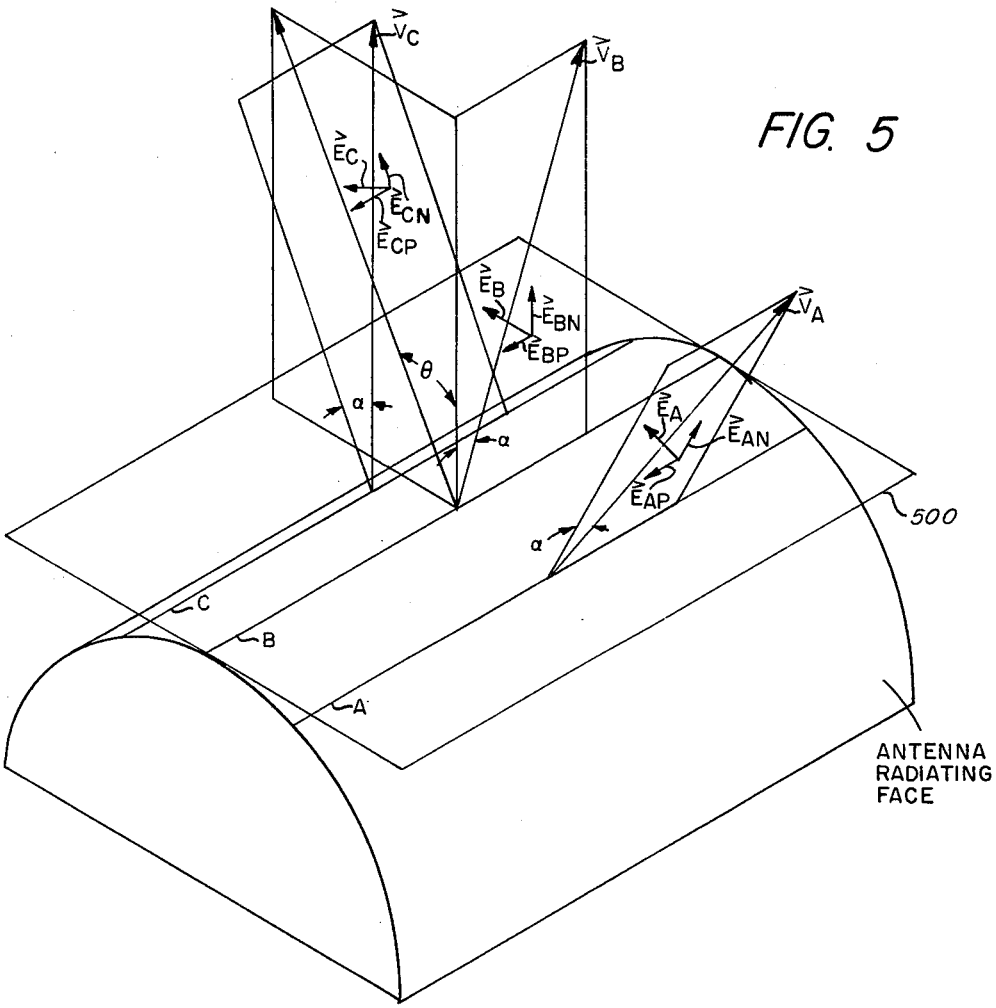
FIG. 5 is a diagram showing "far" electric field components of portions of the cylindrical array shown in FIG. 1.

Referring now to FIG. 1, a cylindrical array antenna 10 is shown to include a plurality of antenna elements 12 arranged in longitudinal rows (not numbered). Such rows are aligned codirectionally with the antenna's longitudinal axis 14. The antenna 10 is adapted (in a manner to be described) to direct a beam of radio frequency radiation in a selected one of *n* overlapping hemispherical sectors disposed regularly about the circumference of the antenna. Each one of the antenna elements 12 includes a phase shifter (not shown) responsive to control signals supplied by a beam steering computer 16 to collimate and direct such beam of radiation in both an "azimuthal" direction, $\theta$, (i.e. circumferentially) and an "elevation" direction, $\alpha$, (i.e. axially) within any selected sector as indicated in FIG. 5. Further, the antenna elements 12 are arranged so that monopulse "sum," "azimuthal difference" and "elevation difference" radiation patterns are developed within such selected sector in a manner to be described hereinafter.

Cylindrical array antenna 10 here includes 228 rows of antenna elements 12 regularly spaced about the circumference of the antenna, here each such row having forty-two antenna elements 12. Antenna elements 12 may be of any conventional design. Here, for example, such antenna elements 12 include a rectangular waveguide section (not shown), preferentially arranged with the narrow wall thereof disposed parallel to the longitudinal axis 14 at the radiating face of the antenna 10, each waveguide section having a ferrimagnetic toroid disposed within such waveguide section as described in the book "Radar Handbook" by M. I. Skolnik, McGraw-Hill Book Company, 1970, in chapter 12. It is here noted that by arranging the waveguide section as described, radio frequency energy will be propagated in the $TE_{10}$ (or dominant mode) and hence the electric field of such energy radiated from any one of the antenna elements 12 (i.e. the polarization) will be oriented codirectionally with the longitudinal axis 14. With such polarization orientation the gain of the antenna is increased by about 2db at elevation angle deflections from a normal to the surface of the antenna, (i.e. $\alpha$, as defined in FIG. 5) in the order of 60° as compared with an antenna operating with a circumferentially oriented polarization.

AXIAL ROW FEED NETWORK

Figure 2:
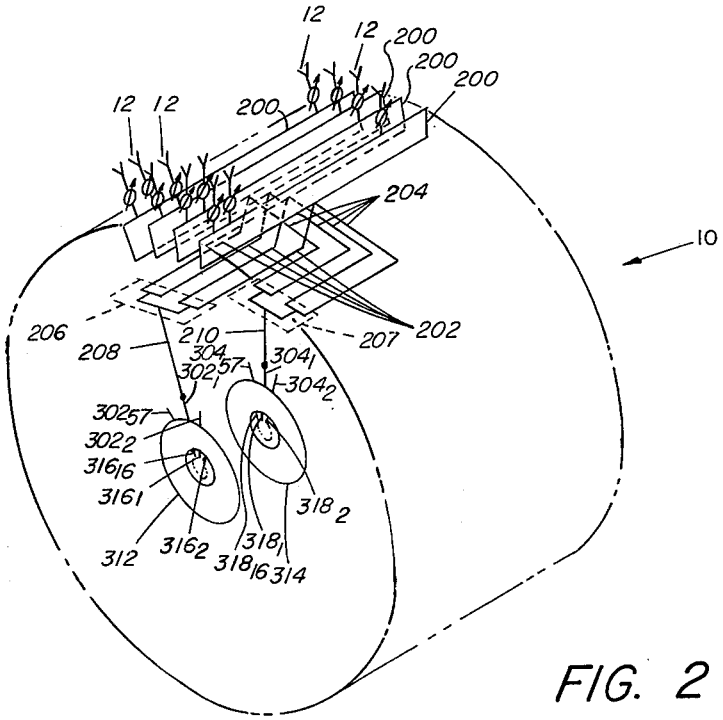
FIG. 2 is a schematic diagram, greatly simplified, of a portion of the cylindrical array antenna shown in FIG. 1, a portion of the antenna elements thereof being shown disposed about a portion of the periphery of the antenna.

Referring now also to FIG. 2, a schematic diagram of the cylindrical array antenna 10 shows antenna elements 12 disposed in exemplary rows about the periphery of the antenna 10. The antenna elements 12 in each row are coupled together by means of an axial row feed network 200. Here such feed network 200 is a center fed series feed network described in the above referenced book "Radar Handbook" on pages 11–50 through 11–54. Each such feed network 200 includes a "sum" port 202 and a separate "difference" port 204. As is known, each one of the antenna elements 12 is coupled in phase to the "sum" port 202 and each "half" (i.e. here the "left half" and the "right half") of the antenna elements in such row are coupled with a 180° relative phase shift therebetween to the "difference" port 204. For convenience, four adjacent rows of antenna elements are, as indicated, grouped together by two conventional "four to one" power dividers 206, 207. In particular, the "sum" ports 202 of four adjacent axial row feed networks are coupled together by power divider 206 to form a "group sum" port 208 and the "difference" ports 204 of such four adjacent axial row feed networks 200 are coupled together by power divider 207 to form a "group difference" port 210. It follows then that 57 "group sum" and 57 "group difference" ports are formed from the 228 rows of antenna elements 12. Each "group sum" port 208 is coupled to a different one of the 57 outer ports $\mathbf{302_1}$–$\mathbf{302_{57}}$ (only $\mathbf{302_1}$, $\mathbf{302_2}$, $\mathbf{302_{57}}$ being numbered) of a centrally fed radio frequency lens, here sometimes called a radial line power divider (sometimes referred to as "sum" and circumferential "difference" radial line power divider) 312, the details of which will be described hereinafter in connection with FIG. 3. Further, each "group difference" port is coupled to a different one of the 57 outer ports $\mathbf{304_1}$–$\mathbf{304_{57}}$, (only $\mathbf{304_1}$, $\mathbf{304_2}$, $\mathbf{304_{52}}$ being numbered) of radial line feed power divider (sometimes referred to as the axial "difference" radial line power divider) 314, here equivalent in construction to radial line feed power divider 312.

Disposed centrally within radial line power dividers 312, 314 are a plurality of *n*, here 16, input feed ports $\mathbf{316_1}$–$\mathbf{316_{16}}$ and $\mathbf{318_1}$–$\mathbf{318_{16}}$ (only $\mathbf{316_1}$, $\mathbf{316_2}$ and $\mathbf{316_{16}}$ and $\mathbf{318_1}$, $\mathbf{318_2}$ and $\mathbf{318_{16}}$ being numbered) respectively. Input feed ports $\mathbf{316_1}$–$\mathbf{316_{16}}$ are coupled to a switching network 400 (not here shown), the details of which will be described in connection with FIG. 4. Suffice it to say here that the beam steering computer 16 sends, in addition to the control signals for the phase shifters (not numbered) associated with antenna element 12, control signals to such switching network 400 to select four of the 16 input feed ports $\mathbf{316_1}$–$\mathbf{316_{16}}$, thereby directing the beam of radio frequency radiation to a selected one of the 16 overlapping hemispherical sectors regularly spaced about the circumference of the antenna 10. Likewise, the input feed ports $\mathbf{318_1}$–$\mathbf{318_{16}}$ are coupled to a switching network 400' (not shown), such network being equivalent in construction to switching network 400. Such switching network 400' also responds to control signals from beam steering computer 16 to select four of the 16 input feed ports $\mathbf{318_1}$–$\mathbf{318_{16}}$ to thereby select the same hemispherical sector selected by switching network 400.

RADIAL LINE POWER DIVIDER

Figure 3:
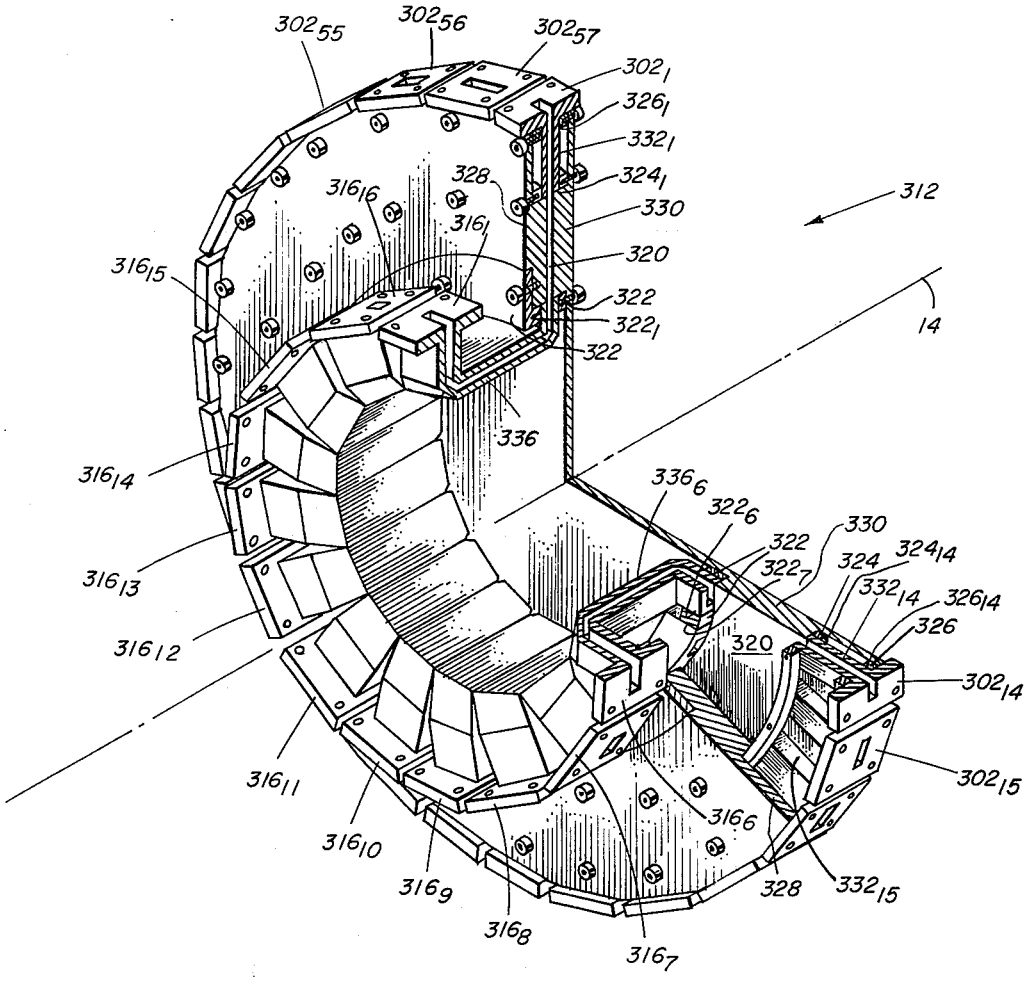
FIG. 3 is an isometric drawing, partially broken away, of a radial line power divider used in the cylindrical array antenna shown in FIG. 1.

Referring now to FIG. 3, an exemplary one of the identically constructed radial line power dividers, 312, 314, here radial line power divider 312, is shown. It is here noted that such power divider may be any conventional, well known, centrally fed radial line power divider. For convenience a particular power divider of such type thereof is shown. Such radial line power divider 312 is used to distribute, with a desired amplitude and phase weighting (established in a manner to be described), the radio frequency energy passing between four selected ones of the 16 input feed ports $\mathbf{316_1}$–$\mathbf{316_{16}}$ and the output ports $\mathbf{302_1}$–$\mathbf{302_{57}}$.

Radial line power divider 312 is here fabricated from aluminum and includes a toroidal parallel plate region 320, a ring 322, a concentric outer ring 324 and a concentric waveguide support ring 326. The radial line feed power dividers 312, 314 are disposed symmetrically about the antenna's longitudinal axis 14 (FIG. 1). Each one of the rings 322, 324, 326 has a plurality of rectangular slots formed therein, such slots being regularly placed about the periphery of such rings. Here ring 322 has 16 such rectangular slots $\mathbf{322_1}$–$\mathbf{322_{16}}$ (only slots $\mathbf{322_1}$, $\mathbf{322_6}$, $\mathbf{322_7}$ being visible in FIG. 3) formed therein whereas outer ring 324 and waveguide support ring 326 have 57 such slots $\mathbf{324_1}$–$\mathbf{324_{57}}$, $\mathbf{326_1}$–$\mathbf{326_{57}}$ (only slots $\mathbf{324_1}$, $\mathbf{324_{14}}$, $\mathbf{326_1}$, $\mathbf{326_{14}}$ being visible in FIG. 3) formed therein. Here the diameters of ring 322, outer ring 324 and waveguide support ring 326 are 5.348 inches, 21.00 inches and 28.900 inches, respectively, for an operating wavelength of approximately 1.2 inches. The size of the rectangular shaped slots formed in the ring 322 is here 0.2 inches by 0.750 inches, the wide wall being disposed circumferentially, with the center to center spacing of such slots being one inch. The rectangular slots formed in the ring 324 are 0.200 inches × 0.750 inches with the center to center spacing being 1 inch.

Front and back disk-shaped covers 328, 330 are mounted to the ring 322, outer ring 324 and waveguide support ring, here by conventional screws (not numbered) thereby forming the parallel plate region 320 between front and back covers 328, 330 and ring 322 and ring 324. The covers 328, 330 are formed so that the inner height of the parallel plate region 320 is equal to the height of the rectangular slot (i.e. 0.2 inches). The condition produces primarily modes having substantially no electric field component parallel to the plane of the parallel plate region and results in maximum power transfer within the parallel plate region 320 without any additional matching devices.

Rectangular waveguide sections $\mathbf{332_{1\text{-}57}}$ are disposed between the rectangular slots $\mathbf{324_1}$–$\mathbf{324_{57}}$ formed within the outer ring 324 and the waveguide support ring 326, as shown. The inner ends of such waveguide sections $\mathbf{332_1}$–$\mathbf{332_{57}}$ are positioned through slots $\mathbf{324_1}$–$\mathbf{324_{57}}$.

Mounting flanges (not numbered) are formed at the outer ends of such waveguide sections $\mathbf{332_{1\text{-}57}}$ as shown to provide output ports $\mathbf{302_{1\text{-}57}}$.

The rectangular slots $\mathbf{322_1}$–$\mathbf{322_{16}}$ formed in the ring 322 are coupled to the inner ends of substantially L-shaped rectangular waveguide sections $\mathbf{336_{1\text{-}16}}$, as shown. The outer ends of such waveguide sections $\mathbf{336_{1\text{-}16}}$ have mounted flanges formed thereon to define the input feed ports $\mathbf{316_{1\text{-}16}}$. It follows then that radio frequency energy entering into any one of the input feed ports $316_1$–$316_{16}$ passes into parallel plate region 320 and is then distributed to waveguide sections $332_1$–$332_{57}$. The distribution to such waveguide sections $332_1$–$332_{57}$ depends on the position of the waveguide sections $332_1$–$332_{57}$ relative to the position of the excited one of the input feed ports $326_1$–$326_{16}$, as described above. The radio frequency energy passing through waveguide sections $332_1$–$332_{57}$ exits via output ports $302_1$–$302_{57}$. It is noted that "on receive" principles of reciprocity apply.

SWITCHING NETWORK

Figure 4:
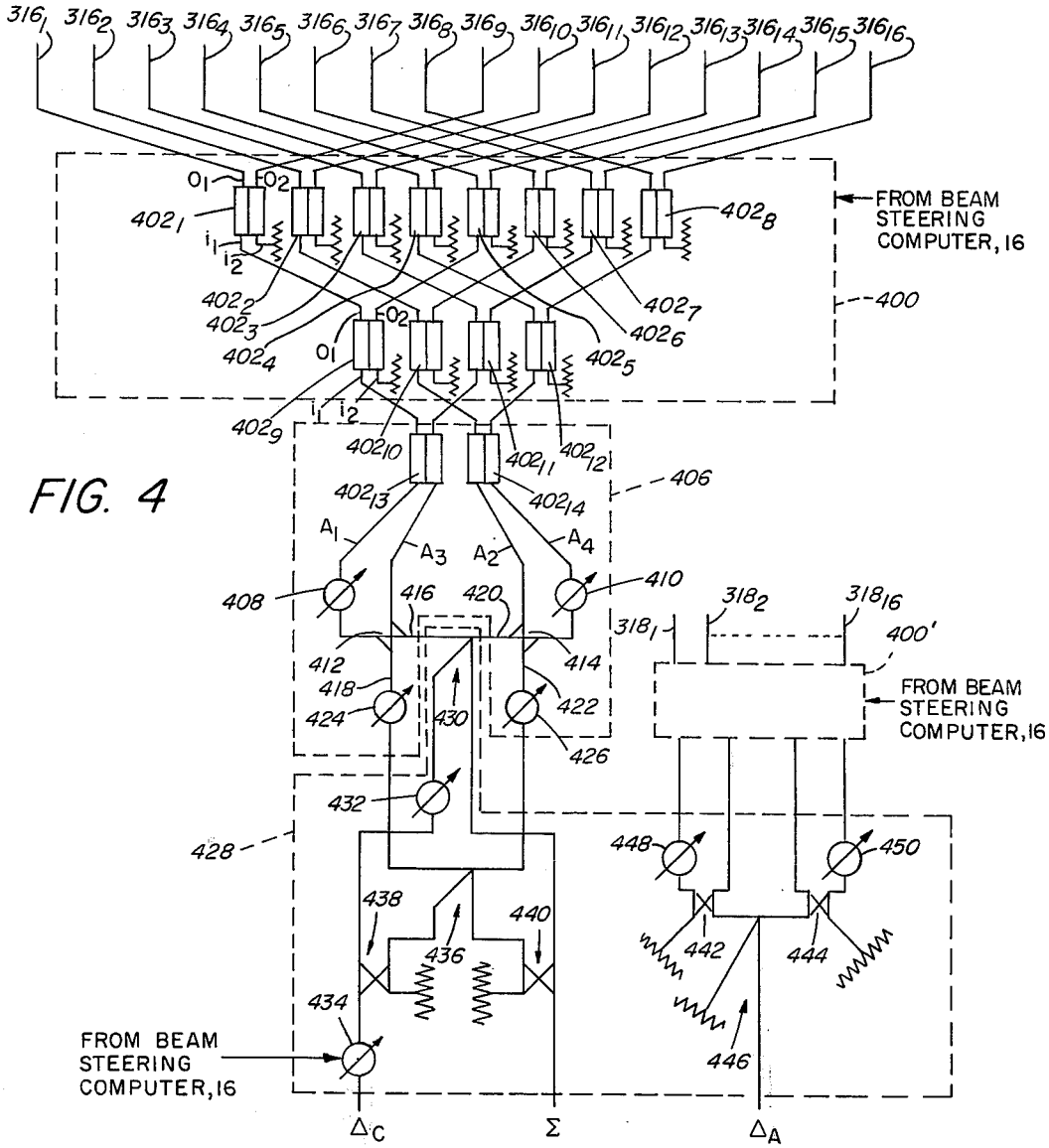
FIG. 4 is a schematic diagram of switching networks, null filling compensator and monopulse arithmetic unit used to complete the cylindrical array antenna shown in FIG. 1.
Figure 4A:
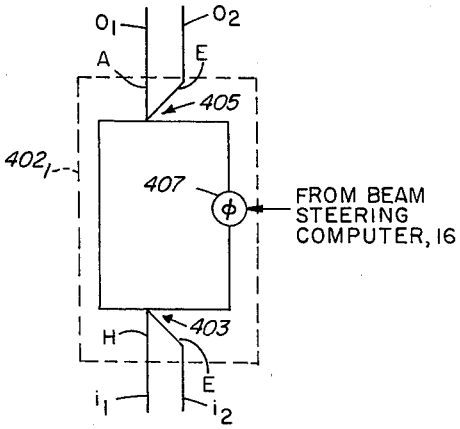
FIG. 4A is a schematic diagram of a switching element used in the switching network shown in FIG. 4.

Referring now to FIG. 4, a schematic diagram is shown of the switching network 400. Such switching network 400, which is identical in construction to switching network 400', includes a first row of switching elements, here switching elements $402_1$–$402_8$, each one thereof having a pair of input terminals indicated by the notation $i_1$, $i_2$ and a pair of output terminals indicated by the notation $o_1$, $o_2$. An exemplary one of the switching elements, say 402, is shown in FIG. 4A, the details of which will be discussed. One of the pair of output terminals, $o_1$, of each one of the switching elements $402_1$–$402_4$ is connected by waveguide to one of the input feed ports $316_1$–$316_4$, respectively, as shown, and the other one of such output terminals, $o_2$, is connected to one of the input feed ports $316_9$–$316_{12}$, respectively, as shown. Further, one of the pair of output terminals, $o_1$, of each one of the switching elements $402_5$–$402_8$ is connected to one of the input feed ports $316_5$–$316_8$, respectively, as shown and the other one of such output terminals, $o_2$, is connected to one of the input feed ports $316_{13}$–$316_{16}$, respectively, as shown. Input feed ports $316_1$–$316_{16}$ are successively and regularly disposed about the inner periphery of the radial line feed power divider 312, as discussed in detail in connection with FIG. 3. One of the input terminals $i_2$ of each one of the switching elements $402_1$–$402_8$ is coupled to a suitable terminating impedance (not numbered). A second row of switching elements is included in switching network 400, here switching elements $402_9$–$402_{12}$, similar in construction to switching elements $402_1$–$402_8$ and each having a pair of output terminals $o_1$, $o_2$. One of the pair of output terminals $o_1$ of each one of the switching elements $402_9$–$402_{10}$ is connected to the input terminal $i_1$ of one of the switching elements $402_1$–$402_2$, respectively, as shown and the other one of the pair of output terminals $o_2$ is connected to the input terminal $i_1$ of one of the switching elements $402_5$–$402_6$, respectively, as shown. Further, one of the pair of output terminals $o_1$ of each one of switching elements $402_{11}$–$402_{12}$ is connected to one of the switching elements $402_3$–$402_4$, respectively, as shown, and the other one of such output terminals $o_2$ is connected to one of the switching elements $402_7$–$402_8$, respectively, as shown. One of the input terminals $o_1$ of the switching elements $402_9$–$402_{12}$ is connected to a suitable matching impedance (not numbered).

Referring to FIG. 4A, the details of an exemplary switching element, here switching element 402, is shown to include a pair of hybrid junctions 403, 405, one "sidearm" of each such junction being coupled together and the other "sidearm" being coupled together through a switchable phase shifter 407. Such switchable phase shifter 407 is here of any conventional design, here adapted to switch to a 0° phase shift condition in response to a "state 1" command signal applied thereto from beam steering computer 16 and to switch to a 180° phase shift condition in response to a "state 2" command signal. One of the pair of input terminals, $i_1$, is connected to the "H-arm" of hybrid junction 403 and the other input terminal, $i_2$, is connected to the "E-arm" of such hybrid junction. One of the output terminals, $o_1$, is connected to the "H-arm" of hybrid junction 405 and the other output terminal, $o_2$, is connected to the "E-arm" of such hybrid junction.

Figure 4B:
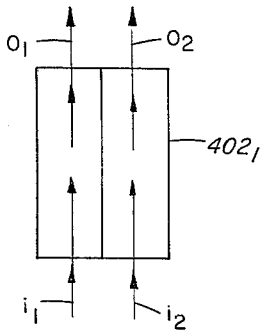
FIGS. 4B and 4C are diagrams useful in the understanding the operation of the switching element shown in FIG. 4A.

In operation, when the switchable phase shifter 407 is in the "state 1" condition, radio frequency energy applied to the input terminal $i_1$ will divide equally, in like phase, between the sidearms of hybrid junction 403. Such "divided" energy will be combined, in like phase, and appear at output terminal $o_1$. Also, when in the "state 1" condition, radio frequency energy applied to the input terminal $i_2$ is divided equally, but in opposite phase (i.e. 180° phase) between the sidearms of the hybrid junction 405. Such divided energy will be combined and appear at the output terminal $o_2$. The operation of such switching element in such "state 1" condition may be represented as shown in FIG. 4B. It is here noted that such switching element is reciprocal, that is the operation of such element is equivalent when radio frequency energy is introduced into the output terminals $o_1$, $o_2$.

Figure 4C:
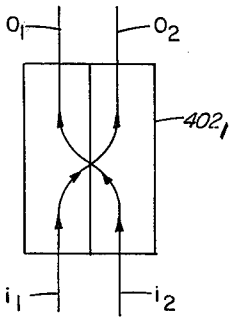

When the switchable phase shifter 407 is in the "state 2" condition, radio frequency energy introduced into input terminal $i_1$ will divide equally, in like phase, between the sidearms of hybrid junction 405. The energy in one of such sidearms will experience a 180° phase shift because of the state of phase shifter 407. Therefore, because such "divided" energy is 180° out-of-phase in the sidearms of hybrid junction 403, such divided energy will combine and appear at output terminal $o_2$. Similarly, if energy is introduced into input terminal $i_2$ it will appear at terminal $o_1$. The state of such switching element in the "state 2" condition may be represented as shown in FIG. 4C.

By properly selecting the "states" for each one of the switching elements $402_1$–$402_{12}$ one of 16 different sets of 4 successively disposed input feed ports may be selectively coupled to the input terminals ($i_1$) of switching elements $402_9$–$402_{12}$. Table I (FIG. 6) shows the "states" required for the switching elements $402_1$–$402_{16}$ in order to selectively couple each one of the 16 different sets of 4 successively arranged input feed ports to the input terminals ($i_1$) of switching elements $402_9$–$402_{12}$ and hence each one of the 16 different hemispherical sectors. It is noted that where there is no "state" indicated for a particular switching element, the feed lines coupled thereto are terminated by a matching impedance. It is further noted that, with such arrangement, the input terminals of switching elements $402_9$ and $402_{11}$ will be coupled to the "odd" numbered input feed ports $316_1$, $316_3$, $316_5$ . . . $316_{15}$ and the input terminals of switching elements $402_{10}$ and $402_{12}$ will be coupled to the "even" numbered input feed ports $316_2$, $316_4$ . . . $316_{16}$. The significance of such "odd"–"even" arrangement will become apparent hereinafter. It is also noted that input feed ports which are not selected are properly terminated in the matching impedance.

"NULL FILLING" COMPENSATOR

A "null filling" compensator 406 is coupled to switching network 400 through a pair of switching elements $402_{13}$, $402_{14}$ to properly couple the selected four successive input feed ports to lines $A_1$–$A_4$. In particular, such switching elements $402_{13}$, $402_{14}$ are provided to couple, respectively, the outer pair of a set of four selected successive input feed ports to lines $A_1$ and $A_4$ and similarly the inner pair of such set of selected successive input feed ports to lines $A_2$, $A_4$. Table II (FIG. 7) shows the coupling between the input feed ports and lines $A_1$–$A_4$ for each one of the 16 hemispherical sectors. Phase shifters 408, 410 are coupled to line $A_1$, $A_4$, respectively as shown and are provided for adjusting the phase of the radio frequency energy on such lines relative to the phase of the energy in lines $A_2$, $A_4$ for reasons to be discussed hereinafter. The phase shifted signals on lines $A_1$ and $A_4$ are combined, as shown, with the radio frequency signals on lines $A_2$ and $A_4$ by conventional directional couplers 412, 414 as shown. With such arrangement the signal on line $A_3$ and the phase shifted signal on line $A_1$ are combined into composite signals on line 416, 418 and likewise the signal on line $A_2$ and the phase shifted signal on line $A_4$ are combined into composite signals on lines 420, 422. Lines 418, 422 are coupled to phase shifters 424, 426, respectively, as shown for reasons to become apparent hereinafter. Phase shifters 424, 426 and lines 416, 420 are coupled to a monopulse arithmetic unit 428.

MONOPULSE ARITHMETIC UNIT

Monopulse arithmetic unit 428 includes a hybrid junction 430, the sidearms of which are coupled, as shown, to lines 416, 420. The "E-arm" of hybrid junction 430 is coupled to $\Delta_C$ output port (i.e. circumferential difference output port) through a phase shifter 432 and a switchable phase shifter 434. Switchable phase shifter 434 is here adapted to provide selectively 0° or 180° phase shift in response to a signal from beam steering computer 16 for reasons to become apparent hereinafter. The "H-arm" of hybrid junction 430 is coupled to the $\Sigma$ output port, as shown. Also included in the arithmetic unit 428 is a hybrid junction 436, the sidearms thereof being coupled to phase shifters 424, 426, as shown. The "E-arm" of hybrid junction 436 is coupled to phase shifter 434 by directional coupler 438 and the "H-arm" of hybrid junction 436 is coupled to the $\Sigma$ output port by directional coupler 440.

The input feed ports $318_1$–$318_{16}$ of radial line power divider 314 are coupled to the monopulse arithmetic unit 428 through switching network 400'. As mentioned above, the same hemispherical sector selected by switching network 400 and coupled to monopulse arithmetic unit 428 is also selected by switching network 400' and coupled to such unit. Therefore, four successive input feed ports $318_1$–$318_{16}$ are coupled to monopulse arithmetic unit 428 when switching network 400' responds to the control signal supplied by beam steering computer 16. Such four selected input feed ports $318_1$–$318_{16}$ are combined in phase into a single output, $\Delta_A$, by directional couplers 442, 444 and hybrid junction 446. In particular, the outputs of directional couplers 442, 444 are coupled to the "sidearms" of hybrid junction 446 and the output $\Delta_A$ (axial difference output port) is coupled to the "H-arm" of such hybrid junction. Here phase shifters 448, 450 are included to provide proper phasing for the signals coupled to radial line power divider 314, as will be described hereinafter.

OPERATION

To more fully understand the operation of the antenna reference is made to FIG. 5 where the radiating face of a selected one of the hemispherical sectors is represented as shown. Let us consider the exemplary rows of antenna elements represented to FIG. 5 by lines A, B and C, the antenna elements represented by line B being symmetrically disposed within the selected sector and the antenna elements represented by rows A and C being symmetrically spaced with respect to the antenna elements represented by line B.

Let us consider that the antenna elements are commanded to direct an antenna pattern at an elevation angle $\alpha$, as indicated by the vectors $\vec{V}_A$, $\vec{V}_B$, $\vec{V}_C$ as shown. The "far" electric field then may be represented by the vectors $\vec{E}_A$, $\vec{E}_B$, $\vec{E}_C$ as shown (i.e. the vector $\vec{V}_A$ being orthogonal to the vector $\vec{E}_A$, the vector $\vec{V}_B$ being orthogonal to the vector $\vec{E}_B$, and the vector $\vec{V}_C$ being orthogonal to the vector $\vec{E}_C$). Such vectors $\vec{E}_A$, $\vec{E}_B$, and $\vec{E}_C$ may be resolved into two orthogonal components; $\vec{E}_{AP}$, $\vec{E}_{AN}$; $\vec{E}_{BP}$, $\vec{E}_{BN}$; and $\vec{E}_{CP}$, $\vec{E}_{CN}$, as shown where the components $\vec{E}_{AN}$; $\vec{E}_{BN}$; and $\vec{E}_{CN}$ are normal to the radiating face of the antenna (the magnitude of such components being approximately proportional to sin $\alpha$).

Figure 5A:
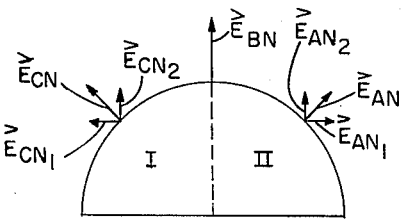
FIG 5A PRIOR ART
FIG. 5A is a diagram useful in understanding the operation of a monopulse antenna according to the prior art.

Referring now to FIG. 5A, let us consider the selected antenna sector according to the prior art as being comprised of two equal antenna aperture segments, I, II as indicated. From the discussion above it is evident that each antenna element now will generate an electric field component normal to the face of the antenna, such component being proportional to sin $\alpha$. If we consider the components associated with the antenna elements represented by lines A, B, and C, such components may be resolved into two orthogonal components: $\vec{E}_{AN_1}$, $\vec{E}_{AN_2}$, $\vec{E}_{CN_1}$ and $\vec{E}_{CN_2}$, one such component being disposed parallel to an antenna "plane" 500 (indicated by the subscript "1") and another component disposed normal to such component (indicated by the subscript "2"). (It is here noted that the magnitude of the component disposed orthogonal to the antenna "plane" 500 associated with the antenna elements represented by line C is zero).

In monopulse operation a monopulse circumferential difference pattern is derived by combining the energy in antenna aperture segment I in opposite phase (i.e. 180° phase relationship) with the energy in antenna aperture segment II. With such arrangement, however, the components (i.e. cross-polarization components) disposed parallel to the antenna "plane" 500 (i.e. $\vec{E}_{AN_1}$, $\vec{E}_{CN_1}$) will add "in phase" because such components are spatially disposed 180° with each other. This will be true for all the antenna elements associated with the selected sector in segment I as compared with those elements in segment II, thereby causing "null filling" to the antenna pattern.

Figure 5B:
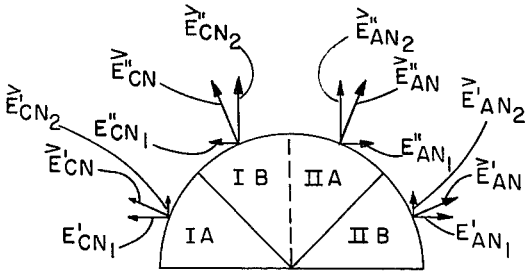
FIG. 5B is a diagram useful in understanding the operation of a monopulse antenna according to the invention.

Referring now to FIG. 5B, the selected hemispherical sector is shown divided into four antenna aperture segments: $I_A$, $I_B$, $II_A$ and $II_B$. Further, from the discussion in connection with FIG. 5, the antenna elements in each row may be considered as effectuating a "far" electric field component disposed normal to the antenna's radiating face, such being represented by exemplary vectors: $\vec{E}_{AN}'$; $\vec{E}_{AN}''$; $\vec{E}_{CN}''$; and $\vec{E}_{CN}'$. Again such vectors may be considered as having one component disposed normal (as indicated by the subscript 2) to the antenna "plane" 500, and another component (i.e. the cross-polarization component) disposed parallel (as indicated by the subscript 1) to such scan plane.

Let us consider the components associated with antenna aperture segments $I_A$ and $I_B$ is represented by exemplary components $\vec{E}_{CN_1}'$ and $\vec{E}_{CN_1}''$. By combining the energy in such segments with a 180° phase shift therebetween, it may be observed that the component of the vectors $\vec{E}_{CN_1}'$ and $\vec{E}_{CN_1}''$ tend to cancel. Further, by appropriately weighting such energy (i.e. attenuating the energy represented by the vector $\vec{E}_{CN_1}'$ greater than the energy associated with the vector $\vec{E}_{CN_1}''$), such cancellation can be effectively complete. Likewise, combining the energy in antenna aperture segments $II_A$ and $II_B$ with a 180° phase shift and with appropriate weighting, the cross-polarization components, or "null filling" effect may be effectively eliminated. In order to maintain proper monopulse operation the energy associated with antenna aperture segments $I_B$ and $II_A$ are combined with a 180° phase shift therebetween in generating a monopulse difference pattern. In summary, then, a proper monopulse circumferential difference pattern is derived with reduced cross-polarization effects (or "null filling") by applying proper amplitude weighting to four adjacent antenna aperture segments and combining alternate segments with like polarity and adjacent segments with opposite polarity.

Implementation of such arrangement is here accomplished through switching network 400, null filling compensator 406, and monopulse arithmetic section 428, as shown in FIG. 4. For convenience the energy associated with antenna aperture segments $I_A$, $I_B$, $II_A$,$II_B$ (FIG. 5B) may be considered as being selectively coupled to lines $A_1$, $A_2$, $A_3$ and $A_4$. Phase shifters 408, 410, 424, 426, 432 and directional couplers 412, 414, 438, 440 are selected in order to obtain proper weighting to the signals on lines $A_1$, $A_2$, $A_3$, $A_4$ and hence to the four selected input feed ports in order to reduce the effect of cross-polarization or "null filling."

In operation, let us consider for purposes of explanation the distribution of energy introduced into the $\Delta_C$ port, realizing that principles of reciprocity hold thereby enabling the discussion to apply the energy received by the antenna. The energy introduced into the $\Delta_C$ port is coupled to the "E-arm" of hybrid junction 436 and the "E-arm" of hybrid junction 430. It follows then that the energy in the sidearms of such junctions will be in opposite phase relationships and hence the energy passing to lines $A_1$, $A_3$ will be in opposite phase to the energy in lines $A_2$, $A_4$. Further, here each left sidearm of such hybrid junctions is coupled to both lines $A_1$ and $A_3$ whereas here the right sidearm is coupled to lines $A_2$, $A_4$. As discussed, lines $A_1$, $A_3$ will be coupled to the "odd" numbered input feed ports and lines $A_2$, $A_4$ will be coupled to the "even" numbered input feed ports. Therefore, the "odd" numbered selected input feed ports will be coupled to the $\Delta_C$ port in 180° phase relationship with the "even" numbered selected input feed ports. Phase shifters 408, 410 are included to provide phase weighting to the outer one of the "odd" numbered selected input feed ports and to the outer one of the "even" numbered selected input feed ports. As discussed, (see Table II) (FIG. 7) switching elements $\mathbf{402}_{13}$, $\mathbf{402}_{14}$ are provided to couple lines $A_1$, $A_4$ to the outer ones of the four selected input feed ports and to couple lines $A_2$, $A_3$ to the inner ones of the four selected input feed ports. It follows, then, referring also to FIG. 5B, that lines $A_1$ and $A_4$ may be considered as being coupled to the "outer" antenna aperture segments, $I_A$, $II_B$, and the lines $A_2$, $A_3$ may be considered as being coupled to the "inner" antenna aperture segments $I_B$, $II_A$ of a selected hemispherical sector. Therefore, because the energy passing to lines $A_1$, $A_3$ is coupled to port $\Delta_C$ in opposite phase to the energy coupled to lines $A_2$, $A_4$, the energy associated with "outer" antenna segments $I_A$, $II_B$ is coupled in opposite phase to port $\Delta_C$ and the energy associated with "inner" aperture segments $I_B$, $II_\Delta$ is also coupled to such port $\Delta_C$ in opposite phase, thereby tending to cancel cross-polarization effects.

Because the phase of the four sectors changes 180° between each adjacent set of four selected input feed ports (i.e. aperture sectors) phase shifter 434 is included to here provide phase 180° when the first input feed port of the set of four selected input feed ports is an "even" number (i.e. hemispherical sectors 2, 4, 6 . . . 16 as in Table II) (FIG. 7) and to provide 0° phase shift when such first input feed port is an "odd" numbered input feed port (i.e. hemispherical sectors 1, 3, . . . 15, Table II (FIG. 7). This is here mechanized by having the beam steering computer provide, in any convenient manner, a binary signal indicative of the selected one of the 16 hemispherical sectors. If the least significant bit is 0, the selected sector is an "odd" numbered sector (i.e. the first input feed port of the set of four selected input feed ports is an "odd" numbered feed port) and a 0° phase shift is provided by phase shifter 434; if the least significant bit is a 1, a 180° phase shift is provided.

Because of reciprocity, radio frequency energy impressed on the Σ port, as during transmission, is coupled to the "H-arms" of hybrid junctions 430, 435 and then distributed to the lines $A_1$–$A_4$. Phase shifters 408, 410, 424, 426 are provided to properly phase the energy on such lines and thereby obtain a desired focusing effect within the parallel plate region of the radial line feed power divider. Satisfactory operation may be obtained by using the following amplitude and phase distribution for the sum (Σ) pattern: The outer pair of feed ports has voltage excitations 40% less than the voltage excitation of the inner pair of feed ports; and, the outer pair of feed ports is phase advanced by 35° with respect to the inner pair of feed ports. For the circumferential difference pattern ($\Delta_C$) satisfactory operation may be obtained by using the following amplitude distribution: The outer pair of feed ports has voltage excitations 60% less than the voltage excitation of the inner pair of feed ports. Such distributions are obtained by properly adjusting phase shifters 408, 410, 424, 426 and 432 and properly selecting directional couplers 412, 414, 438, 440. Further, phase shifters 448, 450 are included to provide phase adjustments analogous to those provided by phase shifters 408, 410 as described above. It is also noted that while phase shifters 408, 410, 422, 424, 432, 448, 450 are shown as variable phase shifters to optimize the feed system, such may be fixed phase shifters once such optimum feed system is obtained.

Having described a preferred embodiment of the invention, other embodiments will immediately become apparent to those of skill in the art. For example, while a cylindrical array antenna has been shown, other nonplanar or conformal array antennas may be used. Also, other feed networks may be used to combine the antenna elements in the rows making up the array antenna. Further, the effect of null filling may be compensated according to the invention when a conformal array antenna used therewith has the "near" electric field associated therewith oriented circumferentially about the radiating face of the antenna. It is felt, therefore, that the invention should not be restricted to its disclosed embodiments but rather should be limited only by the spirit and scope of the appended claims.

What is claimed is:

1. In a conformal antenna, the combination comprising:

a. a plurality of antenna elements arranged in rows about the periphery of the antenna;

b. a radio frequency lens having a plurality of output ports disposed about the periphery of such lens and a plurality of input ports disposed centrally within such periphery of the lens;

c. a switching network means, having a plurality of output terminals connected to the plurality of input ports and having four input terminals, for electrically coupling such four input terminals to a selected set of four of the plurality of input ports; and d. means for coupling alternate ones of the four input terminals with like polarity and adjacent ones of such four input terminals with opposite polarity.

2. The combination recited in claim 1 wherein each one of the antenna elements includes a phase shifter.

3. The combination recited in claim 1 including additionally a second radio frequency lens and wherein each one of the plurality of rows of antenna elements includes a feed network having a "sum" port and a "difference" port, the "sum" port being connected to one of the output ports of the first mentioned radio frequency lens, and the "difference" port being coupled to the second radio frequency lens.

4. The combination recited in claim 3 including additionally a second switching means coupled to the second radio frequency lens; and including additionally a monopulse arithmetic unit coupled to each one of the two switching means.

5. The combination recited in claim 1 including additionally means for adjusting the amplitude of radio frequency energy applied to each one of four selected input ports.

* * * * *